US007159249B2

(12) United States Patent
Dennis et al.

(10) Patent No.: US 7,159,249 B2
(45) Date of Patent: Jan. 9, 2007

(54) SELF-BALANCING, LOAD-DISTRIBUTING HELMET STRUCTURE

(75) Inventors: Michael R. Dennis, Scappoose, OR (US); Gerhard Paasche, Scappoose, OR (US)

(73) Assignee: MJD Innovations, LLC, Scappoose, OR (US)

( * ) Notice: Subject to any disclaimer, the term of this patent is extended or adjusted under 35 U.S.C. 154(b) by 90 days.

(21) Appl. No.: 11/061,916

(22) Filed: Feb. 18, 2005

(65) Prior Publication Data

US 2006/0096011 A1 May 11, 2006

Related U.S. Application Data

(60) Provisional application No. 60/626,702, filed on Nov. 9, 2004.

(51) Int. Cl.
*A42B 7/00* (2006.01)

(52) U.S. Cl. ..... 2/421; 2/414

(58) Field of Classification Search ..... 2/6.6, 2/6.7, 421, 425, 417, 418, 419, 420, 414, 2/416

See application file for complete search history.

(56) References Cited

U.S. PATENT DOCUMENTS 2,340,872 A * 2/1944 Flynn et al. ..... 2/6.6
2,383,597 A 8/1945 Feman
3,105,240 A * 10/1963 Jansson ..... 2/420
3,289,212 A * 12/1966 Morgan ..... 2/420
3,787,895 A * 1/1974 Belvedere ..... 2/9
4,259,747 A * 4/1981 Taesler et al. ..... 2/422
4,692,947 A * 9/1987 Black et al. ..... 2/421
5,119,516 A * 6/1992 Broersma ..... 2/411
5,809,580 A * 9/1998 Arnette ..... 2/426
6,032,297 A * 3/2000 Barthold et al. ..... 2/416
6,108,824 A * 8/2000 Fournier et al. ..... 2/418
6,681,409 B1 * 1/2004 Dennis et al. ..... 2/416
6,804,829 B1 10/2004 Crye et al.
D503,846 S * 4/2005 Gallagher et al. ..... D2/881

* cited by examiner

*Primary Examiner*—Rodney Lindsey
(74) *Attorney, Agent, or Firm*—Joh M. Dickinson, PC; Robert D. Varitz, PC

(57) ABSTRACT

A self-seeking, load-distributing, load-balancing and shock-managing head-engaging system for use inside, and in association with, the shell of a helmet, including (a) a collection of configurationally changeable, shock-absorbing pads removeably and changeably attached/attachable effectively as a variable distribution to the inside of such a shell, and (b) a cinchable, self-seeking/adjusting, self-load-balancing and load distributing chin-strap subsystem operatively associated with the pad distribution, and also attached to the shell. This sub-system is sensitive to the then-particularities of such a pad distribution, and is operable, on cinching of the subsystem through the simple act of pulling on just two strap ends, to stabilize the associated helmet shell on the head of a wearer, with all of the pads in the then-distribution of pads being thereby drawn into proper, defined, shock-managing, load-distributing and load-balancing condition relative to the wearer's head.

3 Claims, 3 Drawing Sheets

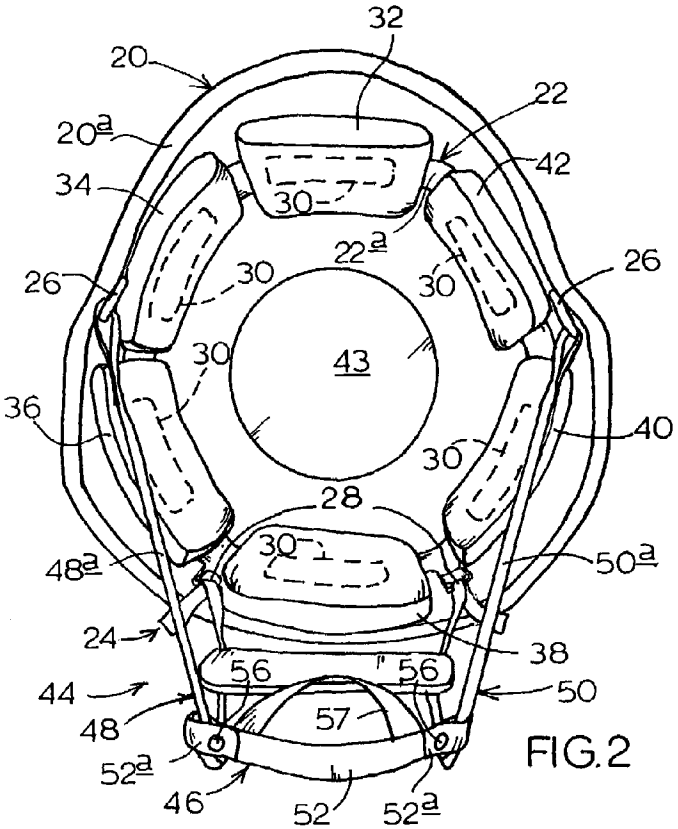
FIG.2
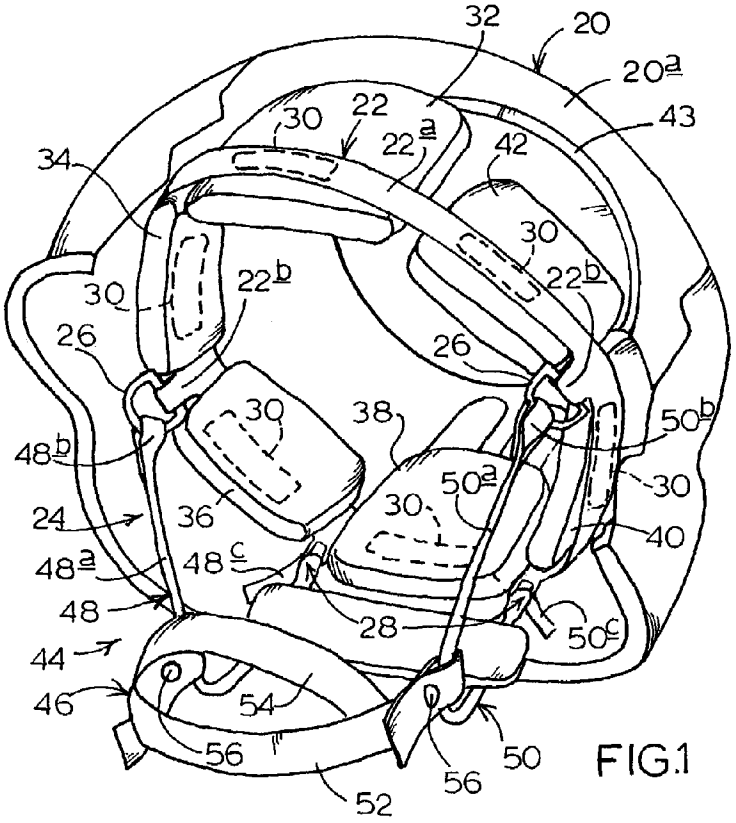
FIG.1
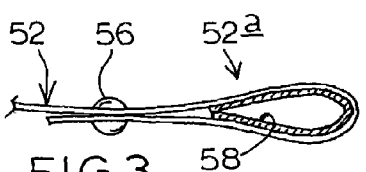
FIG.4
FIG.3
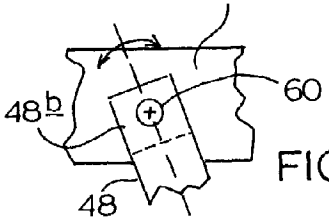
FIG.5

32
34
36
38
30
22a

SELF-BALANCING, LOAD-DISTRIBUTING HELMET STRUCTURE

CROSS-REFERENCE TO RELATED APPLICATION

This application claims priority to prior-filed, U.S. Provisional Patent Application Ser. No. 60/626,702, filed Nov. 9, 2004, for "Self-Balancing, Load-Distributing Helmet Structure". The entire disclosure content of that prior-filed provisional application is hereby incorporated herein by reference.

BACKGROUND AND SUMMARY OF THE INVENTION

This invention relates to protective helmet construction, and in particular to a novel combined self-seeking, load-distributing, load-balancing and shock-managing head-engaging system employable within the shell of a helmet. A preferred and best mode embodiment of the invention is described and illustrated herein in the context of a military helmet—an environment wherein the invention has been found to offer special utility. Incorporated by reference into this text, are the disclosures of U.S. Pat. No. 6,467,099 B2 for "Body-Contact Cushioning Interface Structure", and U.S. Pat. No. 6,681,409 B2 for "Helmet Liner Suspension Structure".

One preferred embodiment of the invention is described and illustrated herein on the inside of a helmet shell which is equipped with a suspension structure, or "frame", suitably anchored to the shell. A very appropriate "frame" for the purpose of implementing and describing this embodiment of the invention is fully illustrated and discussed in above-referenced U.S. Pat. No. 6,681,409 B2. In other recognized embodiments of the invention, which may be best suited for, and therefore preferred in, certain other applications, this frame is omitted, and the invention is employed directly attached to the inside of the shell of a helmet. Such a direct attachment may be made selectively (a) with, or (b) without, the provision and use of attaching throughbores formed in that shell. The conscious absence of such attaching throughbores is preferable in relation to minimizing the existence of weak spots in a helmet shell per se.

Adjustably, changeably and removably attached, as by hook-and-pile fasteners, to this frame are plural, distributed, acceleration-rate-sensitive, shock-absorbing pads, (preferably made in accordance with the teachings of the above referenced U.S. Pat. No. 6,467,099 B2. These pads, as will be seen, may be made, sized and distributed in a number of different ways.

It is a key consideration in the performance of a protective helmet that these shock-absorbing pads engage the wearer's head with what can be thought of as being uniform functionality. That is, each pad should always fully engage the head wherever that pad is specifically located inside the helmet shell, and no matter what the current specific orientation of the pad or worn helmet happens to be. Only with this condition met under all circumstances will the full shock-absorbing capability of the full protective helmet system be "engaged" and available. This is no minor concern. It is, in fact, a critical, life-saving concern, for if there exists inside a helmet some region where an available pad is not fully engaged, a shock impact delivered in the right manner can "exploit" this dangerous, not-properly-engaged situation in a devastating way.

The opportunities for serious misadventure are rampant in a setting, such as a military setting, where plural pads in a helmet can (a) be removed for cleaning, (b) be shifted variously, and as often as desired, to suit the wearer's particular tastes for a comfortable fit, and/or (c) positionally changed for a host of other reasons. This setting, or "condition", absolutely defines a situation wherein there is no predictable constancy of pad "population content" and disposition inside a helmet.

Another type (condition) of varying head-to-pad engagement is that which changes every time that a worn helmet "cocks" unpredictably at different "angles" relative to the head, quite apart from the categories of specific, possible user-selectable changes.

When one marries to these "conditions" a conventional "chin-strap" cinching and tightening structure which traditionally has, except for accommodating differences in "tightness" and "looseness", a substantially "fixed" self-configuration, it is possible that only rarely will the wearer's head be properly fully engaged with installed protective pads, especially where pad population and distribution are also variable.

The present invention dramatically addresses this serious problem situation. It does so, as will be learned from discussion below, read in conjunction with the accompanying drawing figures, by linking to a suspension frame and pad environment, as just above described, a laterally and longitudinally (front-to-rear, etc.) self-adjusting, self-"load-balancing" chin-strap structure. There is no absolute "fixed" configuration for such a chin-strap structure. Rather, this structure automatically "senses" the specific, current head-to-pad engagement condition immediately on the occurrence of its being tightened "into place" to achieve helmet/head stabilization. No matter the pad "condition" (population, disposition) inside a helmet, the cooperative, self-adjusting chin-strap structure and system of the present invention assures at all times that all installed pads will fully and correctly engage the wearer's head.

The various significant features and advantages of the present invention will become fully apparent as the detailed description below is read in conjunction wih the accompanying drawings.

DESCRIPTION OF THE DRAWINGS

FIG. 1 is a bottom isometric view, with certain portions broken away, illustrating a military helmet which is equipped with one preferred and best-mode embodiment of the present invention.

FIG. 2 is a bottom view of the helmet of FIG. 1.

FIG. 3 is an enlarged, fragmentary detail of one preferred embodiment of end loop structure which is employed at each end of one of the two sub-straps (the longer one) featured in a chin-engaging component in the system of the present invention.

FIG. 4 is similar to FIG. 3, but shows here another preferred embodiment of the "longer" sub-strap which possesses differentiated, rather than same, opposite end loop structures.

FIG. 5 is an enlarged, fragmentary detail illustrating a modified, angularly adjustable connection provided for a forward end of a lateral chin-strap element used in the system of the invention.

DETAILED DESCRIPTION OF THE INVENTION

Figures 6, 7, 8, 9, 10:
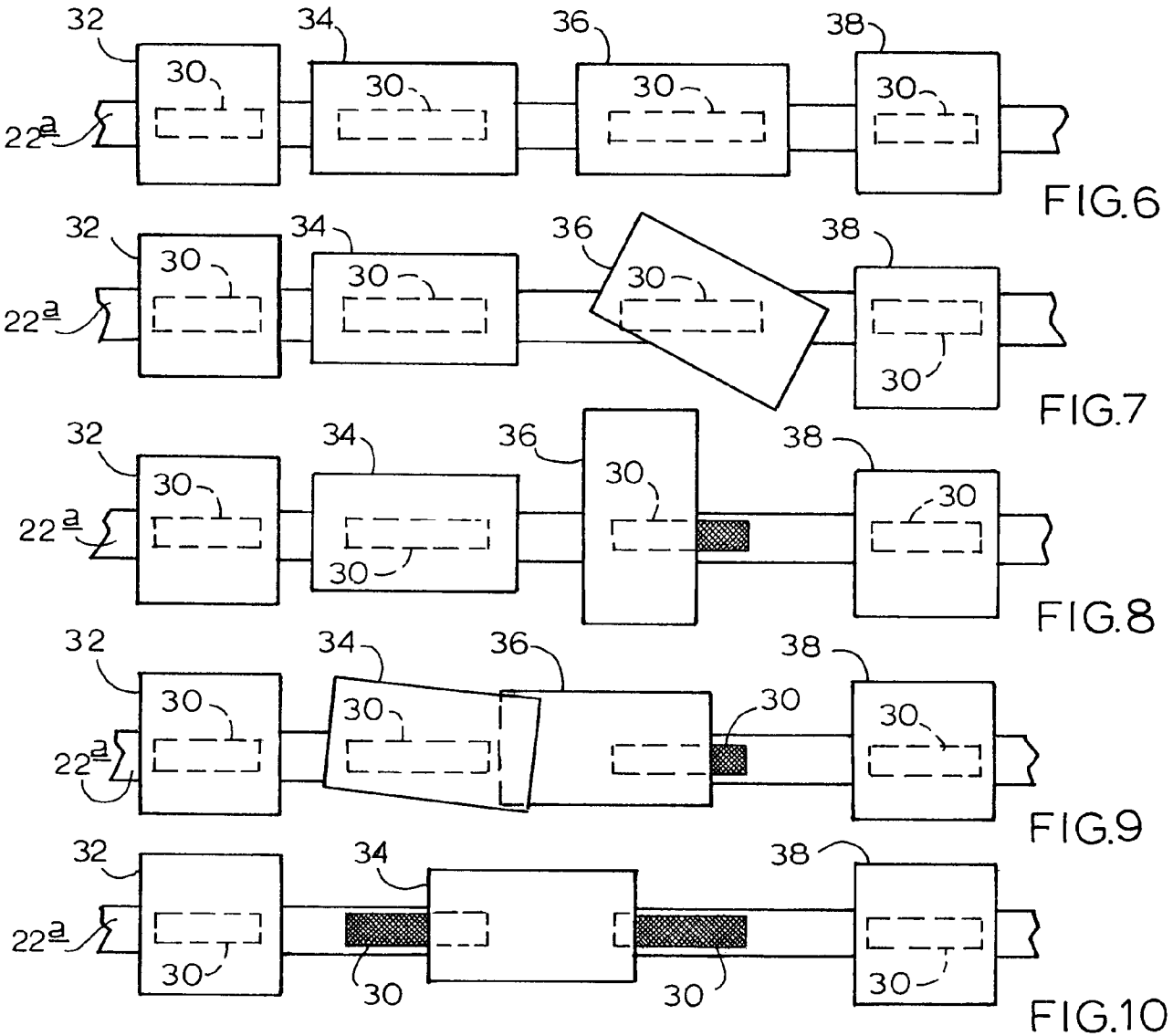
FIGS. 6–10, inclusive, provide fragmentary schematic, developed views of several different, helmet-internal, cushioning pad deployments within the shell of the helmet of FIGS. 1 and 2.

Turning attention first to FIGS. 1 and 2, indicated generally at 20 is a military helmet having a shell 20*a* inside of which is suitably anchored an all-around suspension, or suspension frame, 22 which, herein, is made in accordance with the teachings of above-referred-to, prior-issued, U.S. Pat. No. 6,681,402 B2. Shell 20*a* in FIG. 1 is partially broken away better to reveal the representative operative environment wherein the self-load-balancing self-adjusting, load-distributing helmet safety and support system 24 of this invention is installed for use.

Suspension 22, in general terms, includes a wrap-around, elongate band 22*a* which is directly and appropriately anchored to shell 20*a*, with this band including a pair of forward, lateral strap-end attaching structures 22*b* which, as illustrated particularly in FIG. 1, receive and hold freely dangling, conventional strap-attaching D-rings, such as the two D-rings shown at 26. While these D-rings are per se conventional, their incorporation herein in the context of the practice and behavior of the present invention play a special role in one implementation of the invention—namely in that implementation of the invention which is specifically shown in FIGS. 1 and 2. A modification in this region of the invention is shown in FIG. 4 which will be discussed later herein.

Also carried on band 22*a*, near the rear of helmet shell 20*a*, are two, additional strap-end attaching devices generally shown at 28 which are also per se conventional in design, and which accommodate quick-release strap-end securement. Devices 28 also receive the ends of these straps in a manner which allows for adjustable "pull-relax tightening and loosening" of the strap ends to set and release desired tension in an attached strap. As will thus be observed, cinching and loosening of the chin-strap subsystem which forms part of the present invention is especially simplified and enabled by the employment, as illustrated herein, of devices 28. Uniquely, merely by pulling on and loosening the two chin-strap subsystem strap ends which connect with these devices, all major chin-strap subsystem adjustments are accomplished.

Additionally, frame band 22*a* carries an appropriate distribution, six herein, of one of the two, usual "operative parts" of conventional hook-and-pile fastening elements 30 (see the dashed lines in FIGS. 1 and 2). It is to these elements that plural, six also herein (referred to as a collection), acceleration-rate-sensitive head-engaging, shock-absorbing cushioning pads 32, 34, 36, 38, 40, 42 are removeably, changeably and repositionably attachable. In addition to these just-mentioned, six cushioning pads, in helmet shell 20*a* there is also installed a central, overhead cushioning pad which is shown at 43 in FIG. 2. These pads are preferably made in accordance with the teachings of the above-referenced U.S. Pat. No. 6,467,0099 B2. The outer surfaces of these pads are provided by a fabric which is either preferably constructed to co-act directly with fastening elements 30, or to carry attached patches of material which will do this. These pads form a part of previously mentioned invention system 24.

Looking now at the developed, fragmentary views presented in FIGS. 6–10, inclusive, along with FIGS. 1 and 2, one will see that in FIG. 6, pads 32–38, inclusive are illustrated in essentially the same positions and conditions relative to one another, and relative to suspension band 22*a*, as they are shown in FIGS. 1 and 2. FIGS. 7–10, inclusive, illustrate various different pad placements, positions and "populations". In FIG. 7, pads 32, 34 have not been changed in position. Pad 36 however has been rotated, and pad 38 lowered somewhat in this figure. In FIG. 8, pads 32, 34, 38 remain unchanged, but pad 36 has been significantly rotated and laterally shifted to open up a large gap G between it and pad 38 relative to what is shown in FIG. 6. FIG. 9 shows a condition wherein pads 34, 36 have been moved so close to one another that there is an overlap between then (shown in an exaggerated fashion in this figure). In FIG. 10, pad 36 has been removed, and pad 34 shifted to a location almost centrally between pads 32, 38. In all of these figures, suspension band 22*a* is shown in a simplified form.

There are many reasons why the particularities of the pad arrangement and population may change. A wearer may decide to remove pads for cleaning and then returning; may reorient pads to allow for greater inter-pad ventilation within a helmet shell; may lose a pad; and on placing a pad back in a helmet, may pay little attention to its placement, orientation, etc.

Given this, it is important to note that, if all other aspects of helmet wearing by a particular person were kept exactly the same, save pad placement and disposition, the critical load-bearing and shock-absorbing behavior of the associated helmet, capably addressable by cushioning pads of the type described, would never be the same, and specifically, would likely never be what it should be in terms of head/pad engagement to minimize the likelihood of injury occurring from an impact event. Such a "non-proper" situation is not merely a matter of wearer comfort. It is indeed, a matter perhaps of the difference between safety and extreme danger. The shock-absorbing pads must be properly engaged with a wearer's head to afford the important, potentially life-saving behavior for which they are intended.

Because of this, not unless something is done to "recognize" and adjust for cushioning pad "reorganization", will a helmet system perhaps ever be maximized for safety.

The system (24) of this invention directly addresses this situation by promoting a collaboration with a pad collection like that just described of a unique, self-seeking, self-load-balancing, self-adjusting load-distributing chin-strap subsystem which, no matter the specific pad arrangement in place, will sense and self-seek an appropriate condition which assures that the most correct and effective head/pad state of interengagement becomes established. All pads, because of this unique, cooperative behavior, wherein the chin-strap subsystem effectively "senses" pad organization, will properly, shock-absorbingly engage a wearer's head.

Adding significant complexity and challenge to the issue of assuring, always, proper cushioning pad/head interengagement, is that when a wearer dons a helmet, it is very likely, whether because of pad disposition or not, the orientation of the helmet will probably always never be exactly placed "symmetrically" on the head with regard to the three, orthogonal, spatial X, Y, Z axes of rotation. FIGS. 11–15, inclusive, generally illustrate this complicating, and very real, situation.

Figure 11:
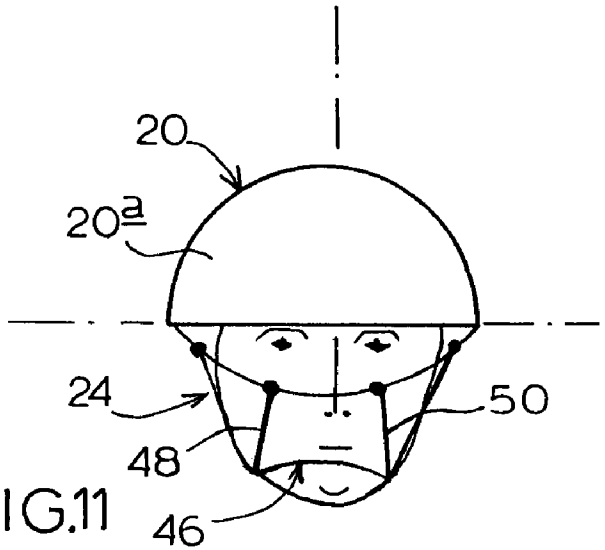
FIGS. 11–15, inclusive, picture several different helmet-on-head conditions which generally illustrate the self-seeking, load-balancing behavior of the present invention.
Figure 12:
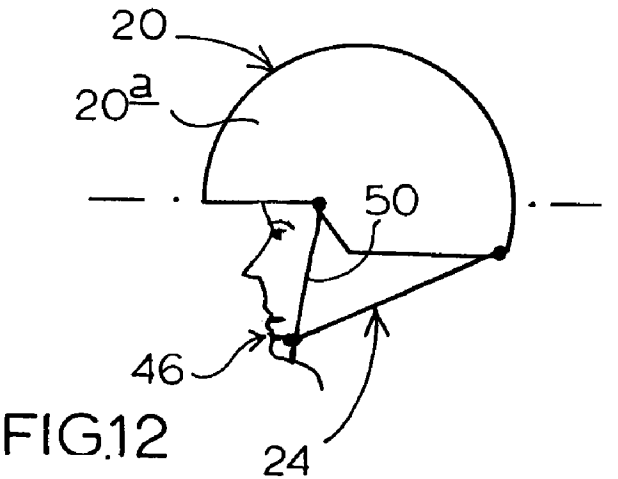
Figure 13:
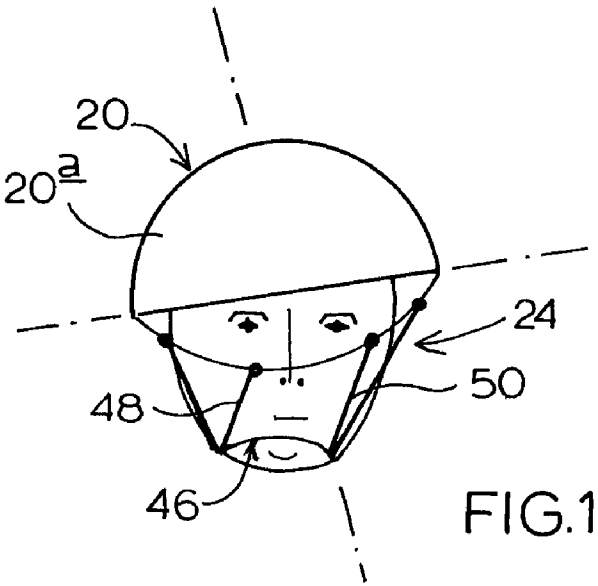
Figure 14:
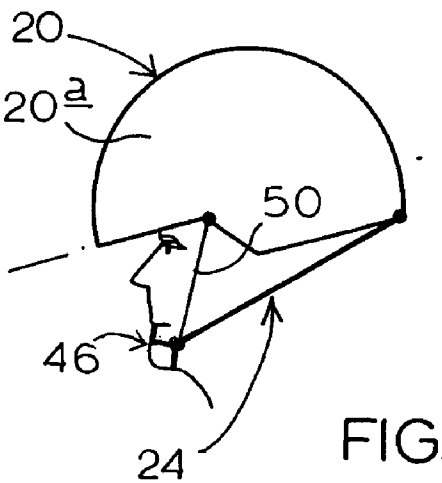
Figure 15:
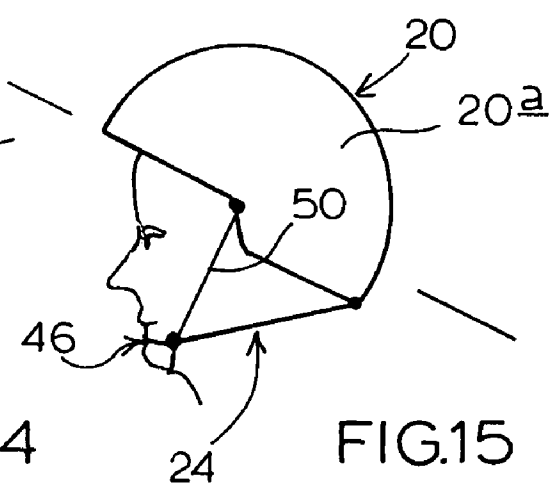

FIGS. 11 and 12 picture what might be thought of as the usually predictably-unattainable "ideal" angular helmet disposition on the head. FIGS. 13, 14 and 15 show situations that differ by different angular head/helmet relationships.

Thinking through what has just been discussed regarding pad disposition, orientation, and population, and helmet angular disposition, it should be apparent that conditions of "nonsymmetrical" helmet angularity, as pictured especially in FIGS. 13–15, inclusive, can came about either because of user placement of a helmet per se, or because of the internal helmet-shell condition of cushioning pad arrangement, or both. With such being the case, the statements made earlier herein respecting the low likelihood of correct engagement ever occurring "casually" between the head and the cushioning pads take on a special element of probable truth.

Not so, however, with the full system and behavior of the present invention in place.

Focusing attention now on FIGS. 1–5, inclusive, in the drawings, further included in system 24 is a unique chin-strap subsystem 44 which includes a chin-strap element, or chin-engaging component, 46, and a pair of elongate, lateral chin-strap elements, or straps, 48, 50. Component 46 is formed with a stitched-together pair of sub-straps clearly shown in the drawings at 52, 54, with the longer one (52) of these two sub-straps, at its opposite ends, being folded in reverse-bend loops 52*a* which freely and slideably receive central, elongate portions 48*a*, 50*a* in lateral/side straps 48, 50, respectively. The interfaces between loops 52*a* and strap portions 48*a*, 50*a* are referred to herein as relative-motion sliding interfaces The term "relative motion" as used herein refers to "whole body" relative motion. It means that each of two "relative-motion" components can move as a whole with respect to the other component. Loops 52*a*, in the embodiment illustrated in FIGS. 1–3, inclusive, are alike, and are held closed by appropriate releasable snaps 56. Portions 48*a*, 50*a* are formed herein by folding and stitching lengths of straps 48, 50, respectively, around, essentially, the long axes (not shown) of these straps.

FIG. 4 shows a modified form of sub-strap 52, wherein its opposite-end loops are different. More specifically, the end of sub-strap 52 which is not shown in FIG. 4 is held closed by a snap like previously mentioned snap 56. Its other end, however, which is shown in FIG. 4 is stitched closed. Stitching is represented at 53 in FIG. 4. The absence of a snap closure at this one end of the sub-strap allows that "side" of the sub-strap, which will ultimately lie essentially against one cheek of a helmet wearer, to have a potentially more comfortable "contact" profile under circumstances, for example, in a military setting where a rifle stock is brought up to and against that same check. Component 46 may, of course, be constructed in two different ways, if desired, to accommodate, selectively, both right-handedness and left-handedness of a user.

This manner of free, slidable connection/interconnection (interface) and adjustability between chin-strap element 46 and lateral straps 48, 50 results in the chin-strap element effectively "floating freely on and along portions 48*a*, 50*a* in the lateral straps. A significant consequence of this unique arrangement is that the chin-strap elements' opposite ends are not, during initial fitting of helmet 20 in place, committed and locked to predetermined fixed locations along the lateral straps.

Turning attention particularly to FIG. 3, in the embodiment of the invention shown here, included appropriately (as by stitching, or bonding) on the insides of loops 52*a* are patches 58 of a suitable pressure-sensitive frictioning material, such as Tough Tek®. See also FIG. 4. During initial fitting of helmet 20 in place, and before any final cinching and tightening/stabilizing occurs, loops 52*a* and these patches do not apply sufficient pressure on lateral strap portions 48*a*, 50*a* to inhibit free sliding of the loops along these strap portions (as will be more fully discussed shortly). This important condition plays a significant role in the self-seeking, self-load-balancing, etc. behavior of the system of the present invention. However, when final cinching/tightening takes place, sufficient pressure builds between the loops and the lateral strap portions to implement the frictioning capabilities of patches 58, with the appreciable result that the loops tend to become effectively "locked" in fixed places relative to the lateral strap portions. This behavior contributes significantly, in most applications, to proper positional stabilization of a "cinched-in-place" helmet 20 on a wearer's head.

Similar frictioning functionality may of course be implemented in that modified form of sub-strap 52 which is shown in FIG. 4.

Such frictioning behavior may, of course, be implemented in other ways than by employing patches, such as those illustrated in FIG. 3 and discussed above. Also, there may well be circumstances where, for certain reasons, one does not desire to use any such frictioning capability at all, and this option is recognized to be yet another appropriate, modified form of the invention.

As seen in FIGS. 1 and 2, the "front" ends of lateral straps 48, 50 are reverse-bend looped, as shown at 48*b*, 50*b*, and through these loops, are freely slidable on the curved regions of D-rings 26. This arrangement provides another important degree of adjustability for the whole chin-strap subsystem assembly.

Digressing for a moment to FIG. 5, here there is shown a modified form of connection for the "front" ends of the lateral straps. Specifically illustrated in this figure is such a modified connection for the front end 48*b* of strap 48. In this modified connection, a D-ring structure is omitted, and strap end 48*b* is simply connected pivotally at 60 to suspension band 22*a*.

The "rear" ends 48*c*, 50*c* of lateral straps 48, 50, respectively, are releasably and adjustably attached to frame 22 through previously mentioned devices 28. See particularly FIG. 1. These devices effectively allow the wearer to "cinch" the helmet in place simply by pulling on the free end portions of ends 48*c*, 50*c*. No other user operation is required to accomplish this.

Because of the way in which all of the elements of the present invention co-act, such cinching will always seat the combined shock-absorbing pads, no matter their precise number or disposition, in proper states of engagement with the head, with essentially completely correct load-balancing tension existing (a) in all of the elements of the chin-strap chin-engaging component per se, and (b) in all regions of the lateral chin-strap elements. The elements of the system of this invention, no matter what turns out to be the organization, disposition, etc. of the cushioning pads, will automatically "sense" that organization and disposition, and through relative sliding and angulating motions which are accommodated at the front ends of lateral straps 48, 50, and at the opposite ends of the chin-strap chin-engaging component, will self-adjust to establish a proper load- and shock-managing organization, without requiring any special care or attention by the wearer.

With the system of this invention installed in and with respect to a helmet shell, and looking now again at FIGS. 11–15, inclusive, and taking into account certain angular exaggerations which have been employed intentionally for illustrative purposes in FIGS. 13–15, inclusive, this balanced, load-distribution set of conditions, with all cushioning pads properly "head-engaged", will exist in all of the various helmet-head relative conditions shown in these five figures.

Thus, as distinguished from prior art helmet structures which are usually improperly disposed on the head with respect to correct load-bearing engagements with the head, a helmet structure employing the system of the present invention will always be properly seated on the head. And while certain preferred and modified forms of the invention have been illustrated and described herein, it is appreciated that variations and modifications may be made without departing from the spirit of the invention. As one illustration of this statement, and was mentioned earlier, we recognize that the system of this invention could be well employed within, and with respect to, the shell of a helmet which is not equipped with a suspension frame, such as frame 22. Other modifications will certainly come to the minds of those skilled in the relevant art, and it is intended that all such variations and modifications come within the scope of the claims herein.

We claim:

1. A helmet head engaging system for use with a suspension frame mounted inside a helmet shell comprising plural, head-engaging shock-absorbing pads prepared for removable and position-adjustable mounting on such a frame, and cooperating chin-strap cinching subsystem structure attachable to the same frame and including frictioning material, and an elongate central chin-engaging component having opposite ends disposed operatively adjacent said frictioning material, and carried in said structure (a) for fore-and-aft, initially free, relative-sliding, load-balancing motion during initial cinching of the cinching structure, and (b), during conclusory cinching of the cinching structure, for frictional anti-slide locking of the chin-engaging component in place, thus to stabilize an associated helmet shell on the head of a wearer.

2. A helmet head-engaging, self-balancing load distribution system, with chin-strap cinch-to-frictionally-lock stabilizing capability, for use with a suspension frame mounted inside a helmet shell comprising plural, head-engaging shock-absorbing pads prepared for removable and position-adjustable mounting on such a frame, and cooperating chin-strap cinching subsystem structure attachable to the same frame, and therethrough to a helmet shell inside of which that frame is mounted, with said subsystem structure including (a) elongate lateral side strap structure, (b) a chin-engaging component having an elongate sub-strap with a pair of reverse-bend loops formed adjacent its opposite ends each curving around and receiving a different portion of said lateral side strap structure, and (c), in each said reverse-bend loop, a reverse-bend patch of frictioning material disposed to engage and tighten functionally and progressively with respect to the associated portion of said lateral side strap structure with cinching-tightening of said chin-strap cinching subsystem structure.

3. A helmet-shell independent, self-balancing, load-distributing, head-engaging system employable inside the shell of a helmet comprising, a suspension frame anchorable to the inside of such a shell, plural, head-engaging, shock-absorbing, load-cushioning pads removably and position-adjustably mountable on said frame, and a chin-strap cinching subsystem structure attachable directly to said frame independent of any associated helmet shell, selectively cinchable to act through said frame on load-cushioning pads mounted on the frame to draw these pads, through interaction through the frame, into self-seeking, self-load-balancing engagement with the head of any wearer of the associated helmet, in a manner which is dependent upon the positions of said pads on said frame, and where said subsystem structure includes an elongate, central chin-engaging component having opposite ends carried in the subsystem structure for fore-and-aft, relative-sliding, load-balancing motion during cinching of the subsystem structure to stabilize an associated helmet shell on the head of a wearer.

* * * * *